US007172488B2

(12) United States Patent
Moll et al.

(10) Patent No.: US 7,172,488 B2
(45) Date of Patent: Feb. 6, 2007

(54) TOY VEHICLE

(75) Inventors: Joseph T. Moll, Redondo Beach, CA (US); Justin Discoe, Windsor, CO (US); Vladimir Leonov, San Pedro, CA (US); Nathan Bloch, Cherry Hill, NJ (US); John M. Clements, Glassboro, NJ (US); Gregory Garneau, Berlin, NJ (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/912,762

(22) Filed: Aug. 5, 2004

(65) Prior Publication Data

US 2005/0148282 A1 Jul. 7, 2005

Related U.S. Application Data

(60) Provisional application No. 60/519,157, filed on Nov. 12, 2003.

(51) Int. Cl.
*A63H 17/00* (2006.01)
*A63H 29/00* (2006.01)
*A63H 30/04* (2006.01)

(52) U.S. Cl. ..... 446/437; 446/454; 446/457; 446/456

(58) Field of Classification Search ..... 446/437, 446/456, 454, 457
See application file for complete search history.

(56) References Cited

U.S. PATENT DOCUMENTS 1,651,292 A 11/1927 Ramage
2,182,642 A 12/1939 Rexford
2,189,759 A 2/1940 Lohr et al.

(Continued)

FOREIGN PATENT DOCUMENTS

GB 2328621 A * 3/1999

(Continued)

OTHER PUBLICATIONS

Mattel Catalog 1999, (front cover, intro page with copyright notice and p. 145), El Segundo, CA.

(Continued)

*Primary Examiner*—Eugene Kim
*Assistant Examiner*—Urszula M. Cegielnik
(74) *Attorney, Agent, or Firm*—Akin Gump Strauss Hauer & Feld, LLP

(57) ABSTRACT

A toy vehicle comprises a lift mechanism which allows the toy vehicle to be lifted from a support surface in a lifting motion and roll end over end over end. The lift mechanism includes a lift arm pivotally mounted to a housing of the toy vehicle. A lift arm actuating motor is coupled to a lift arm drive screw that is in threaded engagement with a lift arm drive nut. A strut is coupled between the drive nut and the lift arm. In operation, the lift arm actuating motor drives the lift arm drive screw and causes the lift arm drive nut to drive the strut and move the lift arm into an extended position, causing the lift arm to engage a support surface to lift the toy vehicle. In the extended position, the toy vehicle is sufficiently rounded to permit the vehicle to roll end over end over end.

20 Claims, 11 Drawing Sheets

U.S. PATENT DOCUMENTS

| | | | | |
|---|---|---|---|---|
| 2,247,354 | A | | 7/1941 | Berger |
| 3,000,137 | A | | 9/1961 | Vine |
| 3,538,640 | A | | 11/1970 | Hayes et al. |
| 3,892,086 | A | | 7/1975 | Gay et al. |
| 4,300,308 | A | | 11/1981 | Ikeda |
| 4,363,187 | A | | 12/1982 | Shinohara |
| 4,466,214 | A | | 8/1984 | Kulesza et al. |
| 4,490,124 | A | | 12/1984 | Ogawa |
| 4,591,346 | A | | 5/1986 | Ikeda |
| 4,666,420 | A | | 5/1987 | Nagano |
| 4,676,763 | A | | 6/1987 | Saito et al. |
| 4,680,021 | A | * | 7/1987 | Maxim ..... 446/457 |
| 4,702,720 | A | * | 10/1987 | Konta et al. ..... 446/448 |
| 4,705,487 | A | | 11/1987 | Ishimoto |
| 4,894,042 | A | | 1/1990 | Kamikawa |
| 4,911,669 | A | | 3/1990 | Parker |
| 5,019,009 | A | | 5/1991 | Chao-Chin et al. |
| D318,924 | S | | 8/1991 | Yoshino |
| D320,821 | S | | 10/1991 | Mochizuki |
| 5,259,808 | A | | 11/1993 | Garr |
| 5,334,075 | A | | 8/1994 | Kakizaki et al. |
| 5,334,077 | A | | 8/1994 | Bailey |
| 5,482,494 | A | | 1/1996 | Ishimoto |
| 5,618,219 | A | | 4/1997 | Simone et al. |
| 5,725,412 | A | | 3/1998 | Ishimoto |
| 5,727,985 | A | | 3/1998 | George et al. |
| 5,727,986 | A | | 3/1998 | Stubenfoll et al. |
| D408,471 | S | | 4/1999 | Smolarczyk |
| D410,258 | S | | 5/1999 | Lerch |
| 5,919,075 | A | | 7/1999 | George et al. |
| D424,132 | S | | 5/2000 | Wei |
| D425,141 | S | | 5/2000 | Park |
| 6,095,890 | A | | 8/2000 | George et al. |
| 6,106,362 | A | | 8/2000 | Keller et al. |
| D431,612 | S | | 10/2000 | Choi |
| 6,439,955 | B1 | | 8/2002 | Feketo |
| 6,478,655 | B2 | | 11/2002 | Wu |
| 6,540,583 | B1 | | 4/2003 | Hoeting et al. |
| 6,565,409 | B1 | | 5/2003 | Isogai |
| 6,620,023 | B2 | | 9/2003 | Yeung |
| 6,692,333 | B2 | | 2/2004 | Kislevitz et al. |
| 6,764,376 | B2 | | 7/2004 | Agostini et al. |
| 6,793,555 | B1 | | 9/2004 | Tilbor et al. |
| 2004/0198165 | A1 | | 10/2004 | Lee et al. |
| 2005/0014447 | A1 | | 1/2005 | Bloch et al. |

FOREIGN PATENT DOCUMENTS

| | | |
|---|---|---|
| JP | 10-66787 | 3/1998 |

OTHER PUBLICATIONS

Mattel Catalog 1999, (front cover, introduction page with copyright notice and p. 145, El Segundo, CA.

U.S. Appl. No. 29/182,350; Justin Discoe, et al., filed May 23, 2003, (Abandoned May 10, 2004).

* cited by examiner

TOY VEHICLE

CROSS-REFERENCE TO RELATED APPLICATIONS

This application claims benefit of U.S. Provisional Patent Application 60/519,157 "Toy Vehicle", filed Nov. 12, 2003, which is entirely incorporated by reference herein.

BACKGROUND OF THE INVENTION

This invention generally relates to toy vehicles and, more particularly, to remote control toy vehicles capable of undergoing tumbling maneuvers.

Toy vehicles which include a mechanism for elevating or lifting the vehicle during normal operation are known. For example, the prior art includes Japanese Patent Publication Number 10-066787 ("JP 10-066787"), which discloses a toy vehicle with a jumping mechanism. As illustrated in FIG. 7 of JP 10-066787, the toy vehicle of that invention is capable of executing only a simple linear jumping motion. Furthermore, the toy vehicle of JP 10-066787 does not disclose a toy vehicle capable of performing controllable tumbling maneuvers. It is believed that a new toy vehicle having a body design and a lifting mechanism which allow the toy vehicle to undergo a controllable tumbling maneuver would provide highly dynamic performance and more engaging play activity than previous toy vehicles.

BRIEF SUMMARY OF THE INVENTION

In one aspect, the present invention is a toy vehicle having a front end and a rear end and first and second lateral sides comprising: a housing including a vehicle body having a generally arcuate shaped lateral side profile; a plurality of road wheels supporting the housing for movement across a support surface and including at least one rear road wheel rotatably mounted proximate the rear end so as to at least partially support the rear end and at least one front road wheel rotatably mounted proximate the front end so as to at least partially support the front end; at least a first motor drivingly coupled with at least one of the front and rear road wheels; and a lift mechanism including a lift arm having first and second ends and a generally arcuate shaped lateral side profile, the second end of the lift arm being free and the first end of the lift arm being pivotally mounted with respect to the housing so as to permit the lift arm to move between a retracted position generally against the housing so as to enable the toy vehicle to be supported on the support surface by the plurality of road wheels and an extended position generally away from the housing so as to contact the support surface and raise the plurality of road wheels from the surface, the toy vehicle having a lateral side profile collectively defined by the arcuate side profiles of the vehicle body and the lift arm in the extended position sufficiently rounded to permit the vehicle to roll end over end over end.

In another aspect, the present invention is a toy vehicle having a front end and a rear end and first and second lateral sides comprising: a housing; a plurality of road wheels located generally beneath the housing and including at least one road wheel rotatably mounted proximate the rear end of the toy vehicle so as to at least partially support the rear end and at least one road wheel rotatably mounted proximate the front end of the toy vehicle so as to at least partially support the front end; a lift mechanism at least partially supported by the housing, the lift mechanism including: a lift arm having first and second ends, the lift arm being pivotally mounted proximate the first end so as to pivot with respect to the housing between a retracted position so as to enable the toy vehicle to be supported on a surface by the plurality of road wheels and an extended position in contact with the surface supporting the toy vehicle so as to raise the plurality of road wheels from the surface; a lift arm actuating motor; a lift arm drive screw operatively coupled with the lift arm actuating motor; a lift arm drive nut in threaded engagement with the lift arm drive screw; and a strut operably coupled between the drive nut and the lift arm at a point intermediate the lift arm first end and the lift arm second end.

In yet another aspect, the present invention is a toy vehicle comprising: a vehicle chassis having a front end and a rear end and first and second lateral sides; at least one rear road wheel rotatably coupled with the chassis proximate the rear end so as to at least partially support the rear end; at least one front road wheel rotatably coupled with the chassis proximate the front end so as to at least partially support the front end; at least a first motor drivingly coupled with at least one of the front and rear road wheels; a vehicle body connected to the vehicle chassis and having a generally arcuate shaped lateral side profile; and a lift mechanism including a lift arm having first and second ends and a generally arcuate shaped lateral side profile, the second end of the lift arm being free and the first end of the lift arm being pivotally connected to the chassis so as to permit the lift arm to move between a retracted position enabling the vehicle to be supported on a surface by the road wheels and an extended position contacting the surface supporting the vehicle and raising the road wheels from the surface, the vehicle having a lateral side profile collectively defined by the arcuate side profiles of the vehicle body and the lift arm in the extended position sufficiently rounded to permit the vehicle to roll end over end over end.

In still another aspect, the invention is a toy vehicle comprising: a vehicle chassis having a front end and a rear end and first and second lateral sides; a plurality of road wheels including at least one road wheel rotatably coupled with the chassis proximate the rear end and located on the vehicle so as to at least partially support the rear end and at least one road wheel rotatably coupled with the chassis proximate the front end and located on the vehicle so as to at least partially support the front end; a lift mechanism attached to the chassis including: a lift arm having first and second ends, the lift arm being pivotally connected to the chassis proximate the first end to move between a retracted position enabling the vehicle to be supported on a surface by the plurality of road wheels and an extended position in contact with the surface supporting the vehicle, and raising the plurality of road wheels from the surface; a lift arm actuating motor; a lift arm drive screw operatively coupled with the lift arm actuating motor; a lift arm drive nut in threaded engagement with the lift arm drive screw; and a strut operably coupled between the drive nut and the lift arm at a point intermediate the lift arm first end and the lift arm second end.

BRIEF DESCRIPTION OF THE SEVERAL VIEWS OF THE DRAWINGS

The foregoing summary, as well as the following detailed description of a presently-preferred embodiment of the invention, will be better understood when read in conjunction with the appended drawings, some of which are diagrammatic. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
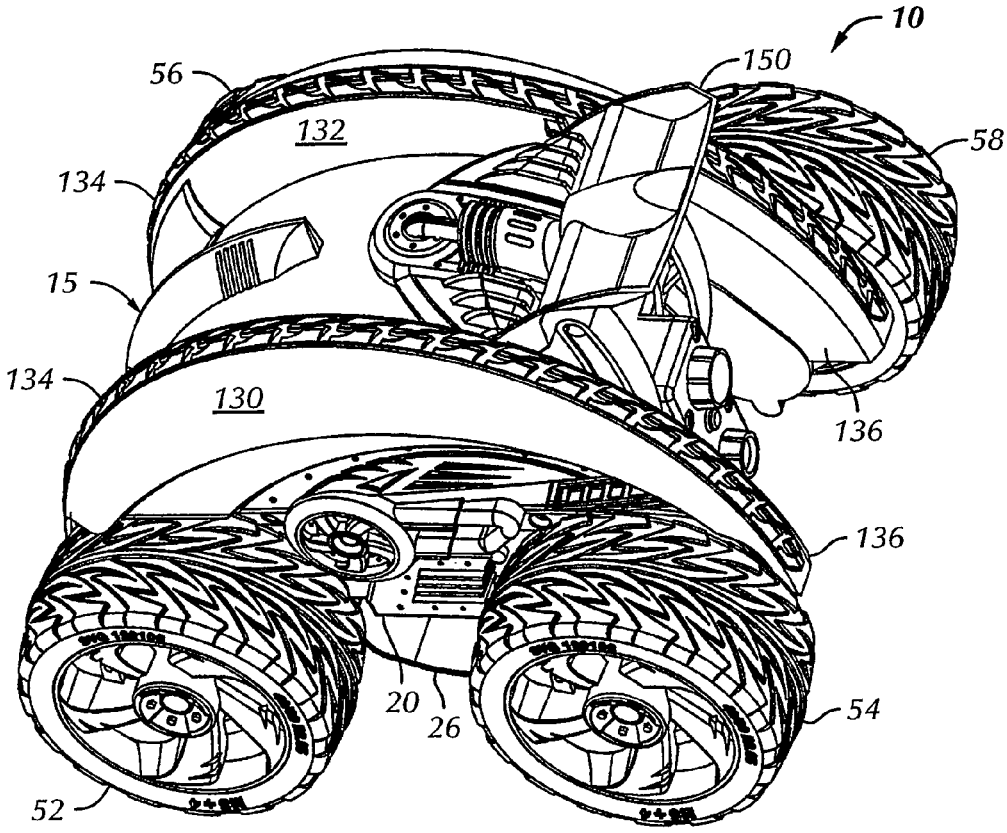
FIG. 1 is a perspective view of a toy vehicle in accordance with a preferred embodiment of the present invention, shown with a lift arm in a retracted position.

Certain terminology is used in the following description for convenience only and is not limiting. The words "right", "left", "upper" and "lower" designate directions in the drawings to which reference is made. The words "inwardly" and "outwardly" refer to directions toward and away from, respectively, the geometric center of the vehicle and designated parts thereof. The word "a" is defined to mean "at least one". The terminology includes the words above specifically mentioned, derivatives thereof, and words of similar import.

Referring to the drawings in detail, wherein like numerals indicate like elements throughout, a toy vehicle 10 includes a housing 15 that in this embodiment includes a chassis 20 and a body 120 mounted to the chassis 20, a plurality of road wheels 52–58 rotatably mounted to the housing 15 and located generally beneath the housing 15, a lift mechanism 60 pivotally mounted to the housing 15, and a strut 100. The term "housing" is intended to broadly cover conventional body and frame (or chassis) combinations like vehicle 10 as well as other combinations such as a monocoque or other constructions like a pair of molded half shells.

Figure 7:
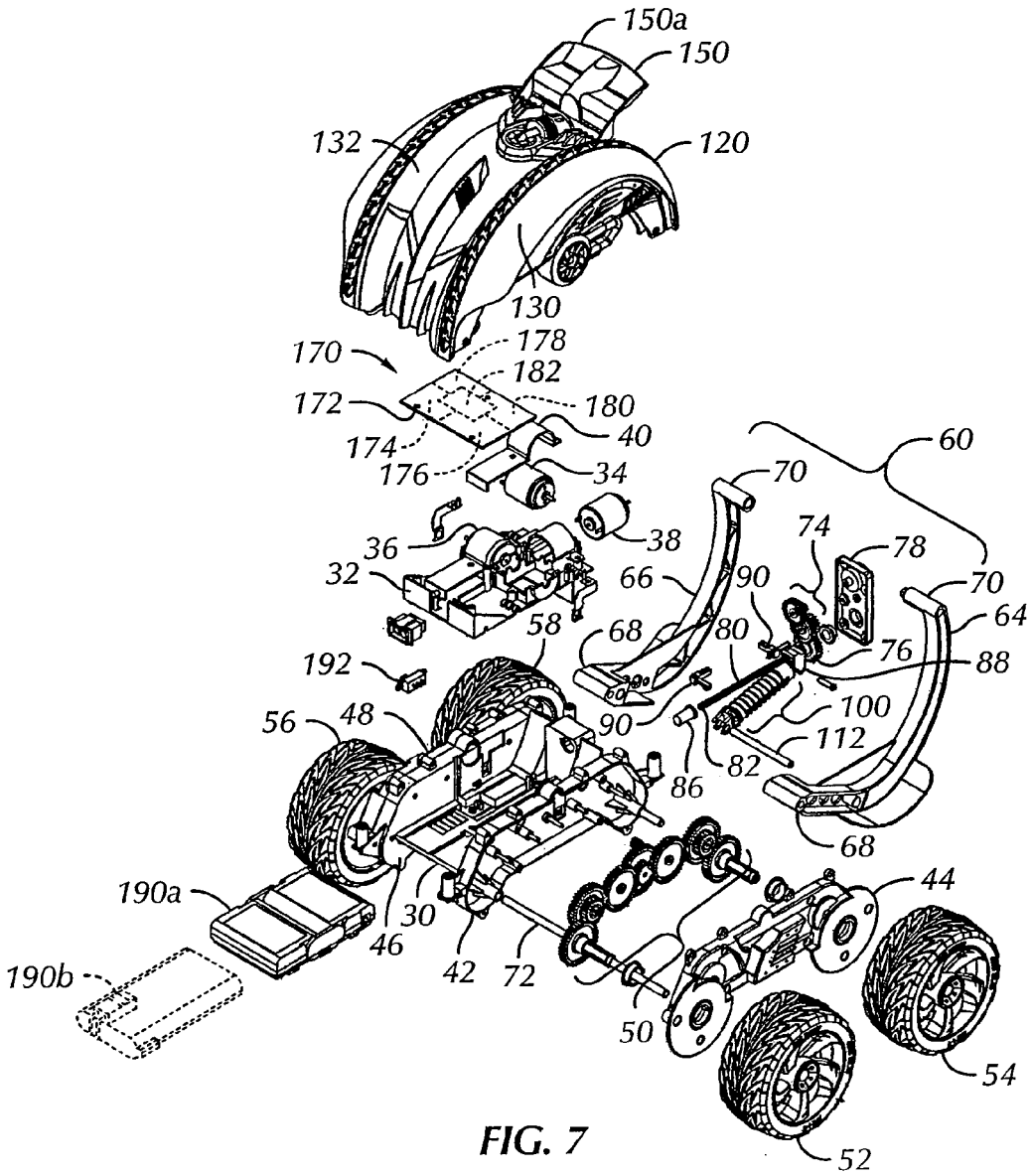
FIG. 7 is an exploded view of the toy vehicle of FIG. 1.

With particular reference to FIGS. 1–7, the vehicle 10, housing 15 and chassis 20 have a front end 22, a rear end 24, a first lateral side 26 and a second lateral side 28. Each of the front wheels 52, 56, mounted proximate front end 22, normally supports at least part of the front end 22 of the vehicle 10/housing 15/chassis 20 while each of the rear wheels 54, 58, mounted proximate rear end 24, normally supports at least part of the rear end 24 for movement across a support surface indicated by "S" in various figures. The term "chassis" 20 is intended to encompass any support frame that might receive a body like body 120. Chassis 20 includes a chassis base plate 30. With reference to FIG. 7, a motor support plate 32 mounts to the chassis base plate 30. Three drive motors are mounted to the motor support plate 32. A first motor 34 is drivingly coupled with at least first and preferably first and second/front and rear road wheels 52 and 54 on the first lateral side, while a second motor 36 similarly is drivingly coupled with at least first and preferably first and second/front and rear road wheels 56 and 58 on the second lateral side. The second motor 36 is preferably operable independently of the first motor 34. This provides "tank steering" in which turning or steering occurs through speed and/or direction differences between the motors. Other drive train arrangements could be used such as belts or shafts or other forms of power transmission. The arrangement disclosed herein is not meant to be limiting. One of ordinary skill in the art of toy vehicles will appreciate that any known steering arrangement could be used with the toy vehicle 10 and that the vehicle does not even need to provide steering control.

The third motor is a lift arm actuating motor 38, and is part of a lift mechanism 60, as described herein below. Each of the three drive motors is mounted to the motor support plate 32 by a clamp attachment 40, which attaches to the motor support plate 32 with a fastener, such as a screw or rivet, and which has a portion formed to match the cylindrical shape of the motors 34, 36 and 38. The clamp 40 is preferably made from aluminum, and serves not only to secure each drive motor in place, but also serves as a heat sink to dissipate heat generated by the drive motors. In this embodiment chassis 20 further includes left and right gearbox housings 42 and 46, respectively, integral with the chassis base plate 30, and left and right gearbox covers 44 and 48, respectively, mating with the left and right gearbox housings 42 and 46 to enclose a left hand drive gear train 50 and a mirror image right hand drive gear train (not illustrated), respectively.

The lift mechanism 60 includes a lift arm 62 operably coupled with lift arm actuating motor 38 preferably through a gear train 74, lift arm drive screw 80, lift arm drive nut 88 and strut 100. More specifically, the lift arm actuating motor 38 rotates a lift arm drive screw 80 through an operably coupled gear train 74. The gear train 74 is housed within the chassis base plate 30 and a gear train cover 78 and is operatively engaged with a drive screw gear 76 which is fixedly attached to the lift arm drive screw 80. The lift arm drive screw 80 has a first end 82 which is supported for rotation by a bushing 86. The lift arm drive screw 80 is in threaded engagement with a lift arm drive nut 88, which travels over a portion of the length of the lift arm drive screw 80 as the lift arm drive screw 80 rotates.

The lift arm 62 comprises a left hand portion 64 and a right hand portion 66 and has a generally arcuate shaped lateral side profile. The lift arm 62 has a first end 68 and a second end 70. The lift arm 62 pivotally mounts to the chassis 20 proximate the first end 68 so as to pivot with respect to the housing 15 preferably via a pivot shaft 72 which preferably also serves to support front wheels 52, 56. The lift arm 62 moves between a retracted position 62*a* (FIGS. 1-6) generally against the housing 15 so as to enable the toy vehicle 10 to be supported on the support surface by the plurality of road wheels 52–58 and an extended position 62*b* (FIG. 10) generally away from the housing 15 so as to contact the support surface S and raise the plurality of road wheels 52–58 from the surface under action of the lift arm actuating motor 38. Limit switches 90 operate to prevent movement of the lift arm 62 beyond the desired extended and retracted positions, 62*a*, 62*b*.

Figure 9A:
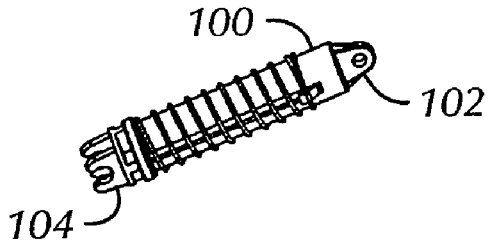
FIG. 9A is a side view of a shock assembly of the toy vehicle of FIG. 1.
Figure 9B:
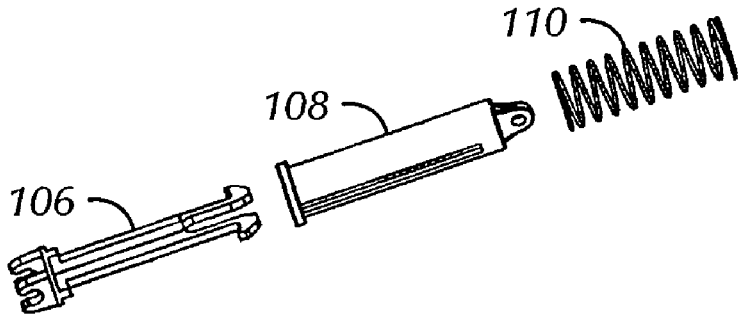
FIG. 9B is an exploded view of the shock assembly of FIG. 9A.

With reference now to FIGS. 7, 9A and 9B, strut 100 is pivotally connected to the lift arm drive nut 88 at a first end 102 and rigidly (rigidly in at least a direction of rotation corresponding to movement of the lift arm 62 from the retracted position 62*a* to the extended position 62*b*) connected at a second end 104 to the lift arm 62 via a pivot shaft 112. The strut 100 is preferably also a shock assembly and includes a shock absorber arm 106 sliding in a shock absorber sleeve 108 mounting a spring 110. The strut 100 is biased by the spring 110 into a "bottomed out" position shown on FIG. 9A, wherein the arm 106 is biased into engagement with the sleeve 108. Thus, the strut 100 can be elongated, but not shortened, from its nominal spring-biased position. This configuration operably couples the strut/shock assembly 100 and its spring 110 with the lift arm drive nut 88.

Figure 2:
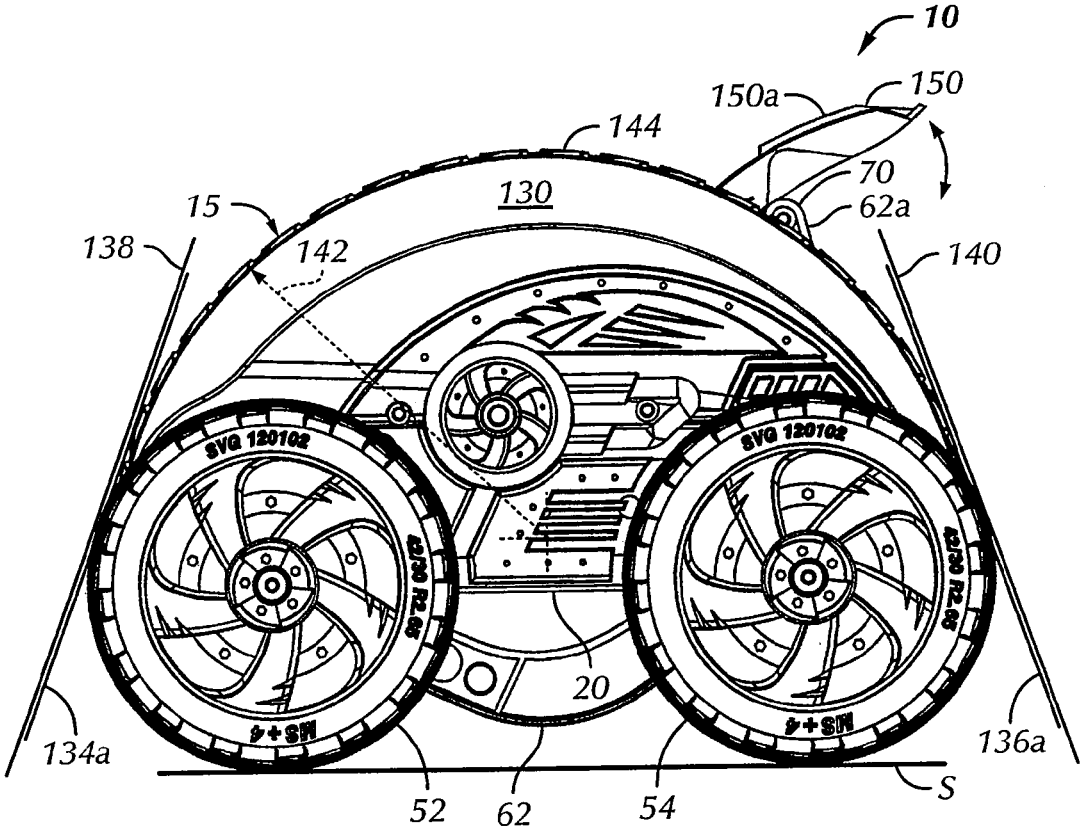
FIG. 2 is a side elevation view of the toy vehicle of FIG. 1.
Figure 3:
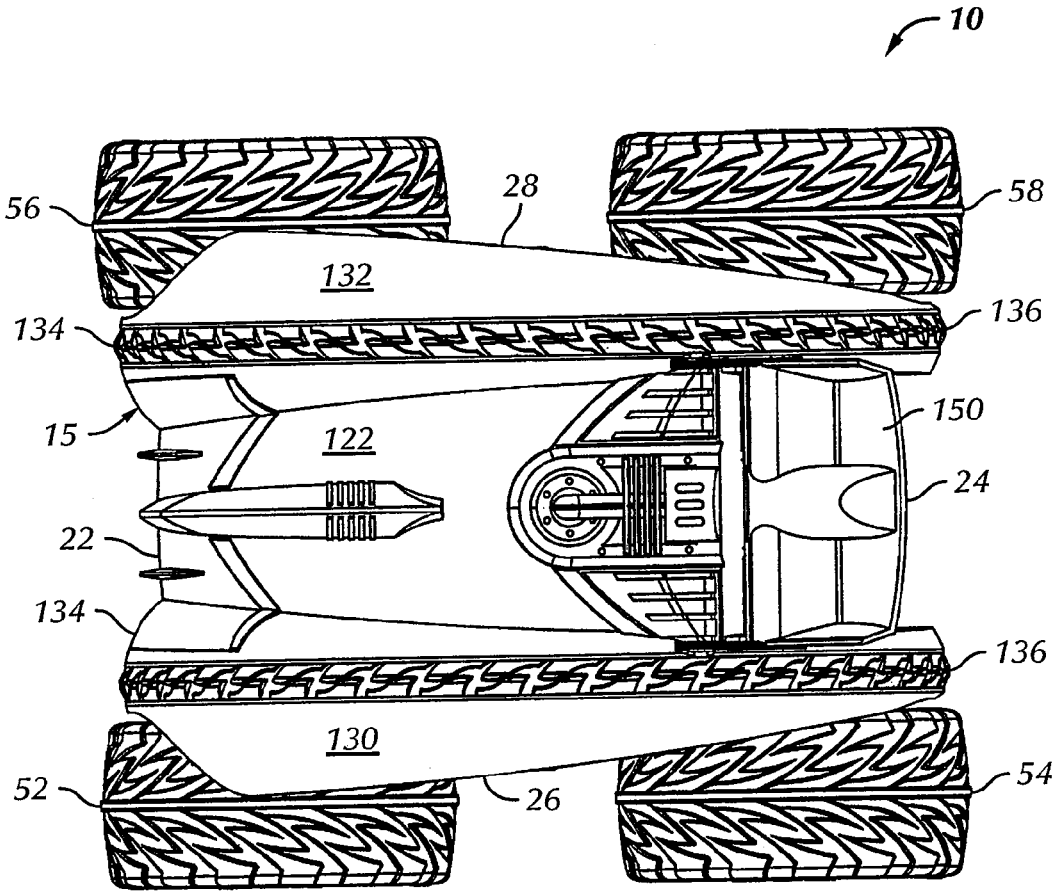
FIG. 3 is a top plan view of the toy vehicle of FIG. 1.
Figure 4:
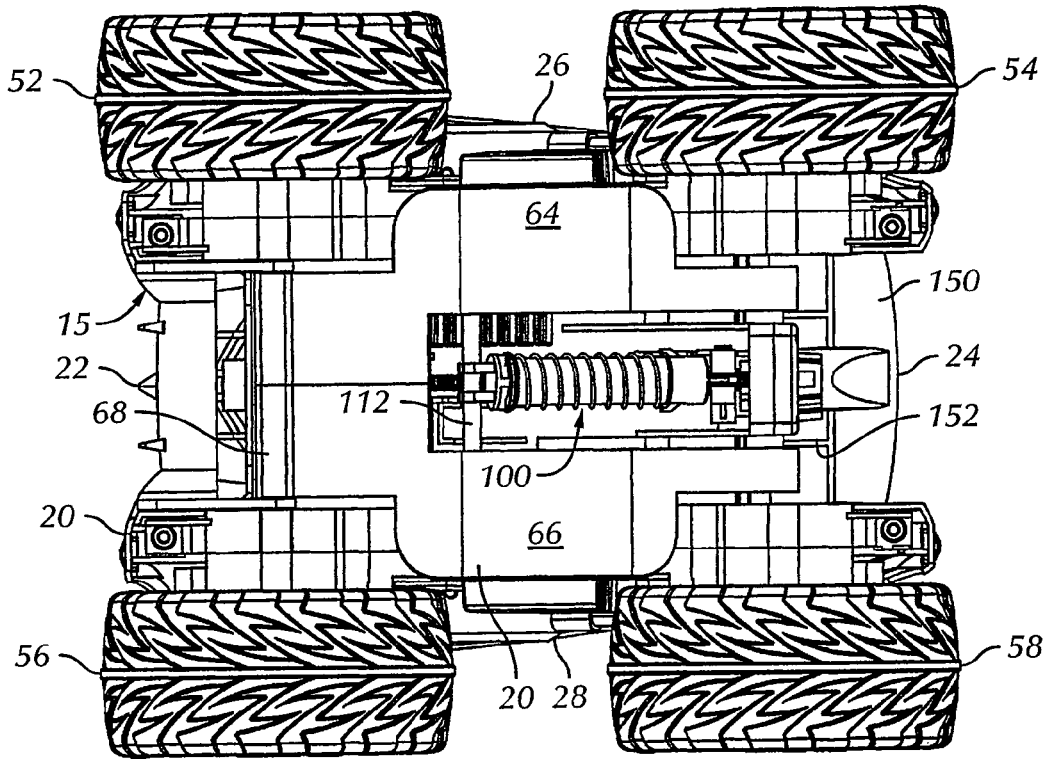
FIG. 4 is a bottom plan view of the toy vehicle of FIG. 1.
Figure 5:
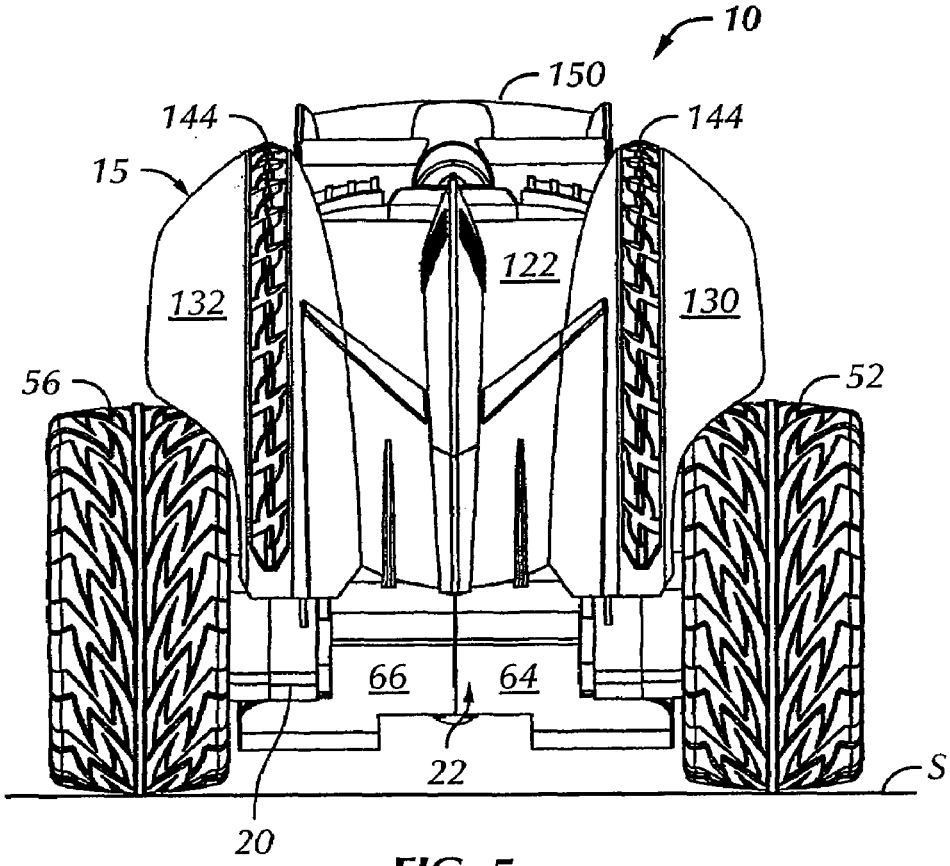
FIG. 5 is a front elevation view of the toy vehicle of FIG. 1.
Figure 6:
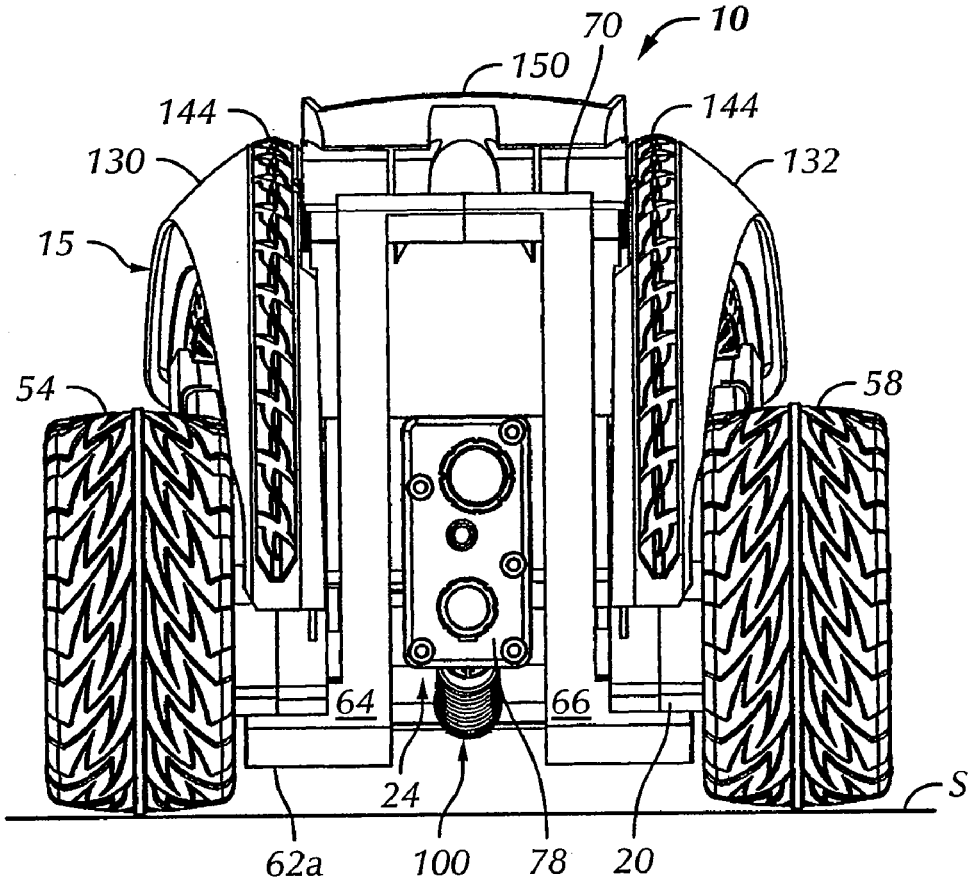
FIG. 6 is a rear elevation view of the toy vehicle of FIG. 1.
Figure 8:
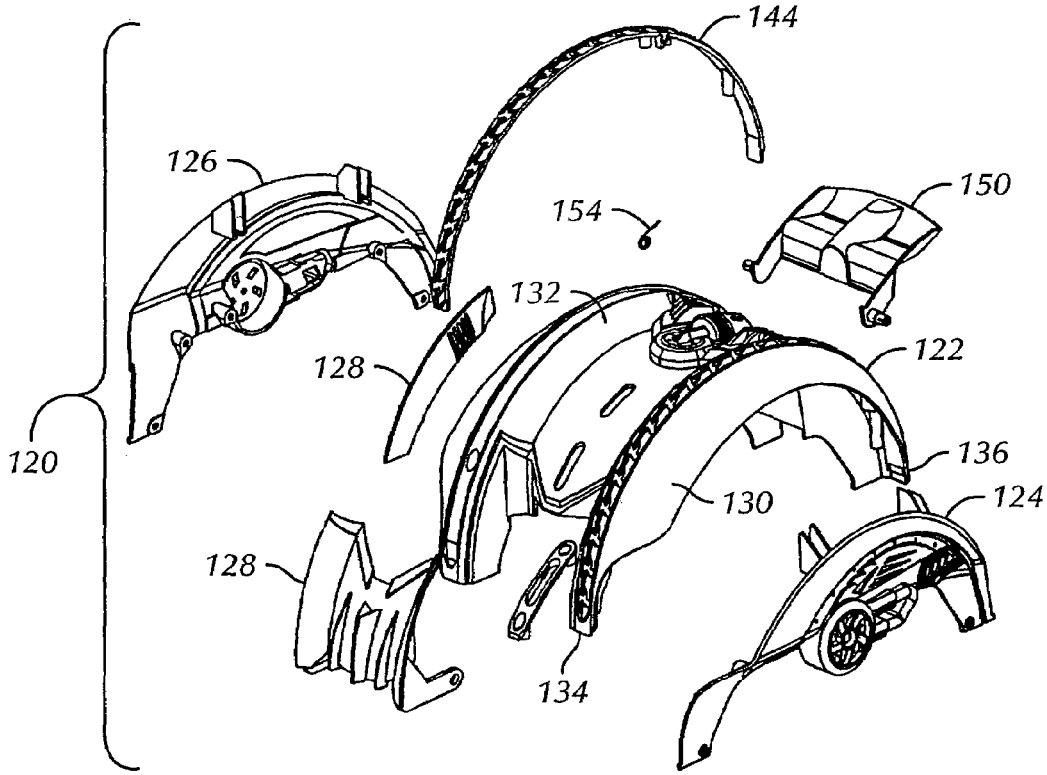
FIG. 8 is an exploded view of a central body of the toy vehicle of FIG. 1.

With particular reference to FIGS. 1, 2 and 8, the body 120, having a generally arcuate shaped lateral side profile, preferably is an assembly including a central body 122, a left body panel 124, a right body panel 126 and decorative panels 128. First and second arcuate skid members 130, 132 preferably extend generally radially from the central body 122 and are positioned outwardly from the central body 122 to protect the central body 122 during rollover. Each skid member 130, 132 has a first end 134 and a second end 136. First ends 134 each have a tangent line 134*a* which is nearly coplanar with a first tangent plane 138 which is tangent to outer portions of front wheels 52, 56. Similarly, second ends 136 each has a tangent line 136*a* which is nearly coplanar with a second tangent plane 140, which is tangent outer portions of the rear wheels 54, 58. The skid members 130, 132 have a generally arcuate shaped lateral side profile between the first and second ends of the skid members, the skid member side profile having a radius 142. This design allows the toy vehicle 10 to undergo a smooth and efficient end over end over end tumbling motion as the toy vehicle 10 rolls over the front wheels 52, 56, skid members 130, 132 and rear wheels 54, 58. Skid rails 144 of a more resilient, higher friction coefficient material may be attached along the outermost radial portions of the skid members 130, 132.

A wing 150 is preferably provided pivotally mounted on the housing 15, more specifically to the central body 122. The wing 150 is biased by a torsion spring 154 into a retracted position (not illustrated), essentially within the arcuate lateral side profile of the vehicle body 120, when the lift arm 62 is in the extended position 62*b*. When the lift arm 62 is in the retracted position 62*a*, the lift arm second end 70 engages a bottom surface 152 of the wing, and pushes the wing 150 into a deployed position 150*a* extending outwardly from the arcuate lateral side profile of the vehicle body. In addition to functional features of the wing 150 described below herein, the wing 150 has an aesthetic function.

Figure 10:
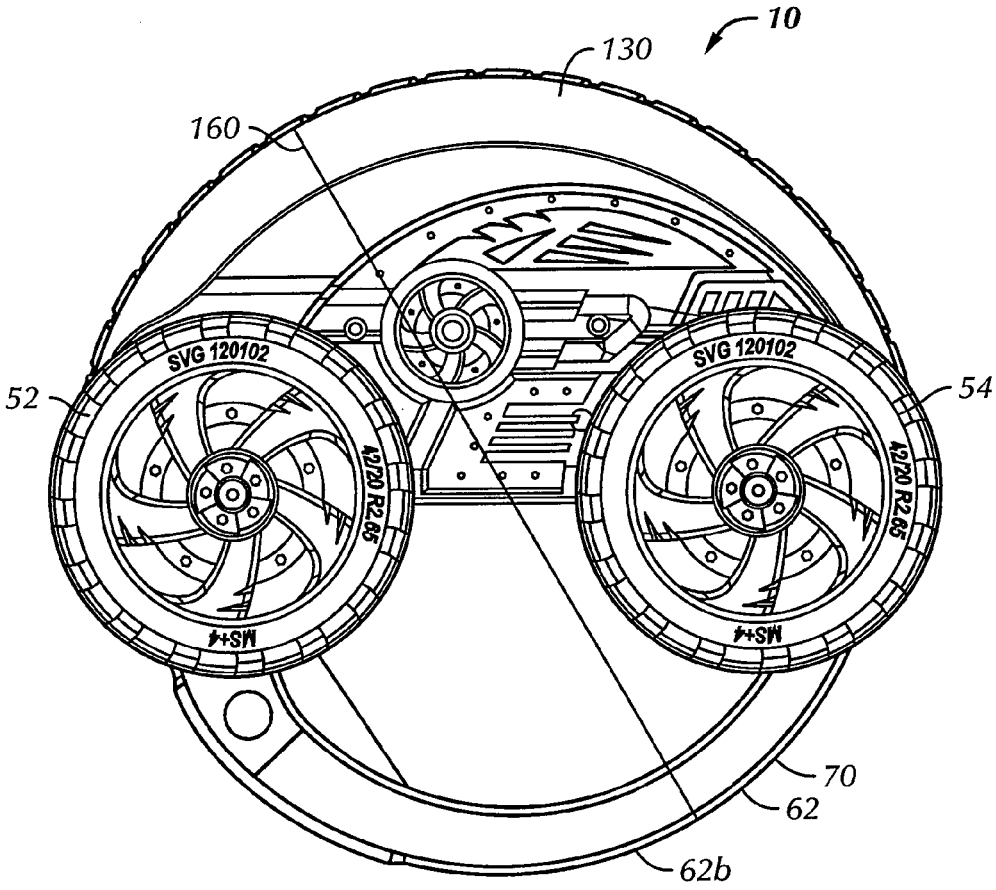
FIG. 10 is a side elevation view of the toy vehicle of FIG. 1, shown with a lift arm in an extended position.

With particular reference to FIG. 10, when the lift arm 62 is in its extended position 62*b*, the combination of the lift arm 62, the outer perimeters of the wheels 52–58, and the skid members 130, 132 has a side profile which is generally arcuate in shape. The arcuate profile has a diameter 160 which is approximately double the radius 142.

Figure 11:
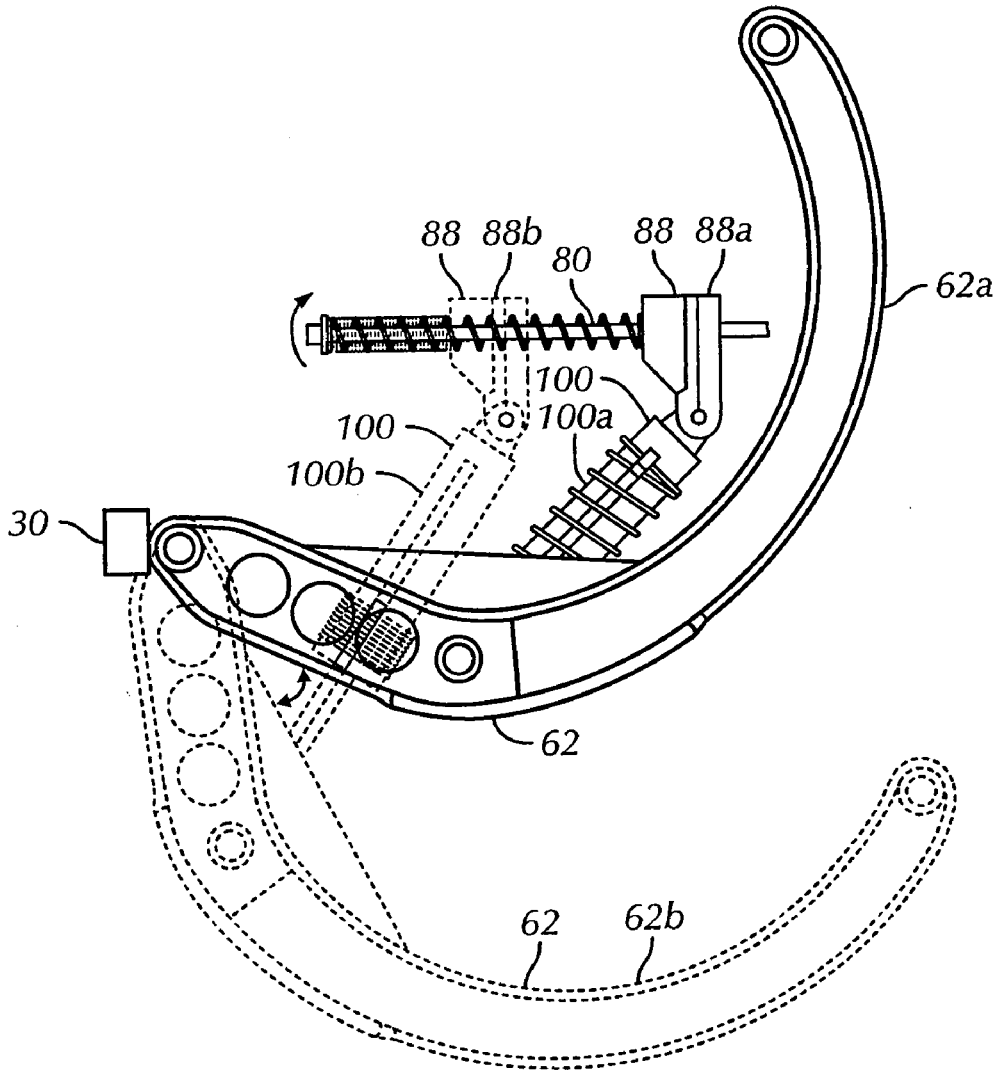
FIG. 11 is a diagrammatic representation of movement of the lift arm between the retracted position of FIG. 1 and the extended position shown in FIG. 10.

FIG. 11 depicts diagrammatically how the lift arm 62 is moved between the extended position 62*a* generally away from housing 15 and the retracted position 62*b* generally against housing 15. As the lift arm drive nut 88 moves from a first position 88*a* to a second position 88*b*, the lift arm 62 pivots about the chassis base plate 30 from the retracted position 62*a* to the extended position 62*b*. The length of the strut 100 is constant as it moves between a first position 100*a* associated with lift arm drive nut first position 88*a*, and a second position 100*b*, associated with lift arm drive nut second position 88*b*, as the shock absorber arm 106 is biased into engagement with the shock absorber sleeve 108 by the spring 110.

Control of the toy vehicle 10 is conventional. Referring to FIG. 7, the toy vehicle 10 includes control circuitry 170 preferably mounted to a circuit board 172. The control circuitry 170 includes a wireless signal receiver circuit 174, a first motor control circuit 176, a second motor control circuit 178 and a lift arm drive motor control circuit 180, all operatively coupled with and together through a central processor 182. Control circuitry 170 is operatively connected to an on-board electrical power supply 190, preferably a rechargeable battery, and in particular, a flexible segmented battery pack 190*a*. Alternatively, other sources of power could be provided, for example, solar cells, capacitive power supplies or other sources of electrical power, such as a standard rigid battery 109*b*, and/or supported in or on or indirectly by the chassis. The circuitry 170 is responsive to user commands from a wireless transmitter (not depicted) to selectively operably couple the power supply 190 with each of the three motors 34, 36, 38. The toy vehicle 10 preferably is further provided with an on/off switch 192.

In operation, a user activates the toy via the on/off switch 192. The user may then proceed to use the wireless transmitter (not shown) to control operation of the three drive motors 34, 36 and/or 38. The toy vehicle 10 may be steered in the manner of a tank by varying the relative direction and/or speeds of rotation of first motor 34 and the left side wheels 52, 54 and the second motor 36 and right side wheels 56, 58. The user may further command the lift arm actuating motor 38 to rapidly move the lift arm 62 between the retracted position 62*a* and extended position 62*b* by rotation of the lift arm drive screw 80. In the extended position 62*b* the lift arm 62 extends beyond a plane defined by the outermost lower surfaces of the wheels 52–58, such that the lift arm 62 strikes a support surface S on which the toy vehicle 10 is traveling. Thus, the lift arm 62 tends to impart a lifting force to the toy vehicle 10 as the lift arm 62 moves from the retracted position 62*a* to the extended position 62*b*. Once lifted off of the wheels 52–58, given the sufficiently rounded lateral profile of the toy vehicle 10 collectively defined by the arcuate side profiles of the vehicle body 120 and the lift arm 62 in the extended position, the toy vehicle 10 tends to roll or tumble end over end over end as long as the lift arm 62 is in the extended position 62*b* and the toy vehicle 10 has sufficient momentum to sustain the rolling motion. When the lift arm 62 is returned to the retracted position 62*a* by the operator and the road wheels 52–58 are allowed to contact a support surface S, the toy vehicle 10 resumes conventional four-wheel drive operation.

An abrupt change in the direction of rotation of the wheels of the toy vehicle 10 may also initiate a tumbling maneuver, even if the lift arm 62 is in the retracted position 62*a*. If the rotation is abruptly changed from forward to reverse propulsion, a forward roll motion may be initiated. If the lift arm 62 is in the retracted position 62*a*, the wing 150 is biased by the lift arm 150 into the wing's deployed position 150*a*. As the toy vehicle 10 tumbles forward in the forward roll, the toy vehicle 10 rolls over the wing 150. In so doing, the wing 150 is pushed against the lift arm 62, tending to move the lift arm 62 into the extended position 62*b* or partially toward the extended position 62*b* and also tending to pull the strut 100 in tension against the bias of the spring 110. Thus, when the toy vehicle 10 is engaged in a forward roll and the lift arm 62 is in the retracted position 62*a*, the lift arm 62 can be momentarily moved at least toward the extended position 62*b* by the wing 150.

Alternatively, if the rotation of the toy vehicle 10 wheels is abruptly changed from reverse to forward propulsion, a backward roll motion may be initiated. In this case, if the lift arm 62 is in the retracted position 62*a*, the wing 150 remains in the deployed position 150*a*, and extends radially beyond the skid member radius 142. If the toy vehicle 10 has sufficient momentum, the wing 150 acts as vaulting member, and tends to lift the toy vehicle 10 from a support surface S as the support surface S rolls into engagement with the wing 150.

As yet another alternative, if the wing 150 is in the deployed position 150*a* during a backward roll and the momentum of the toy vehicle 10 is sufficiently low, the toy vehicle 10 may assume a stable position wherein the toy vehicle 10 is supported by the rear wheels 54 and 58 and the wing 150. In such a position, continued operation of the rear wheels 54 and/or 58 can result in additional dynamic maneuvers, for example, 360 degree spin maneuvers.

From the foregoing it can be seen that the present invention comprises a toy vehicle capable of performing highly dynamic and entertaining stunt maneuvers.

It will be appreciated by those skilled in the art that changes could be made to the embodiment described above without departing from the broad inventive concept thereof. For example, although the embodiment discussed above refers to actuation of the lift mechanism by initiation of a remote control signal, other modes of initiation could be used. For example, the lift mechanism could be actuated automatically after driving the vehicle in a forward direction (or any direction) for a predetermined period of time or a predetermined distance, or after a certain speed is reached or exceeded, or when commanded to perform a particular maneuver. Alternatively, user commands to extend the lift arm could be inhibited by the circuitry until after a predetermined speed or a time of operation or distance of movement was equaled or exceeded. Although the invention is described herein in terms of the preferred, four-wheeled embodiments, the present invention could also comprise a vehicle having three wheels, or more than four wheels. The toy vehicle 10 is preferably controlled via radio (wireless) signals from the wireless transmitter (not shown). However, other types of controllers may be used including other types of wireless controllers (e.g. infrared, ultrasonic and/or voice-activated controllers) and even wired controllers and the like. The vehicle 10 can be constructed of, for example, plastic or any other suitable material such as metal or composite materials. Also, the dimensions of the toy vehicle 10 shown can be varied, for example making components of the toy vehicle smaller or larger relative to the other components. It is understood, therefore, that this invention is not limited to the particular embodiment disclosed, but it is intended to cover modifications within the spirit and scope of the appended claims.

We claim:

1. A toy vehicle having a front end and a rear end and first and second lateral sides comprising:

a housing including a vehicle body having a generally arcuate shaped lateral side profile;

a plurality of road wheels supporting the housing for movement across a support surface and including at least one rear road wheel rotatably mounted proximate the rear end so as to at least partially support the rear end and at least one front road wheel rotatably mounted proximate the front end so as to at least partially support the front end;

at least a first motor drivingly coupled with at least one of the front and rear road wheels; and a lift mechanism including a lift arm having first and second ends and a generally arcuate shaped lateral side profile, the second end of the lift arm being free and the first end of the lift arm being pivotally mounted with respect to the housing so as to permit the lift arm to move between a retracted position generally against the housing so as to enable the toy vehicle to be supported on the support surface by the plurality of road wheels and an extended position generally away from the housing so as to contact the support surface and raise the plurality of road wheels from the surface, the toy vehicle having a lateral side profile collectively defined by the arcuate side profiles of the vehicle body and the lift arm in the extended position sufficiently rounded to permit the vehicle to roll end over end over end, wherein the lift mechanism further comprises:

a lift arm actuating motor;

a lift arm drive screw operably coupled with the actuating motor; and a lift arm drive nut in threaded engagement with the lift arm drive screw and operably coupled with the lift arm.

2. A toy vehicle as in claim 1, further comprising:

a wing mounted on the housing so as to move into a deployed position extending outwardly from the arcuate lateral side profile of the vehicle body when the lift arm is in the retracted position and to move into a retracted position essentially within the arcuate lateral side profile of the vehicle body when the lift arm is in the extended position.

3. A toy vehicle as in claim 1, wherein the lift mechanism further comprises:

a strut operably coupling the drive nut and the lift arm at a point intermediate the lift arm first end and the lift arm second end.

4. A toy vehicle as in claim 1, wherein the lift mechanism further comprises a shock assembly with a spring operably coupled with the drive nut.

5. A toy vehicle as in claim 1, further comprising a gear train operatively coupling the lift arm actuating motor and the lift arm drive screw.

6. A toy vehicle as in claim 1, wherein the first motor is drivingly coupled with at least two road wheels on the first lateral side of the toy vehicle.

7. A toy vehicle as in claim 5, wherein the first motor is drivingly coupled with at least one road wheel on the first lateral side of the toy vehicle and the toy vehicle further comprising:

a second motor drivingly coupled with at least one of the plurality of road wheels located on the second lateral side of the toy vehicle, the second motor being operable independently of the first motor.

8. A toy vehicle as in claim 7, further comprising control circuitry including a wireless signal receiver operatively connected to an electrical power supply, wherein the circuitry with receiver selectively operably couples the electrical power supply with each of the first and second motors and the lift arm actuating motor.

9. A toy vehicle having a front end and a rear end and first and second lateral sides comprising:

a housing including a vehicle body having a generally arcuate shaped lateral side profile;

a plurality of road wheels supporting the housing for movement across a support surface and including at least one rear road wheel rotatably mounted proximate the rear end so as to at least partially support the rear end and at least one front road wheel rotatably mounted proximate the front end so as to at least partially support the front end;

at least a first motor drivingly coupled with at least one of the front and rear road wheels; and a lift mechanism including a lift arm having first and second ends and a generally arcuate shaped lateral side profile, the second end of the lift arm being free and the first end of the lift arm being pivotally mounted with respect to the housing so as to permit the lift arm to move between a retracted position generally against the housing so as to enable the toy vehicle to be supported on the support surface by the plurality of road wheels and an extended position generally away from the housing so as to contact the support surface and raise the plurality of road wheels from the surface, the toy vehicle having a lateral side profile collectively defined by the arcuate side profiles of the vehicle body and the lift arm in the extended position sufficiently rounded to permit the vehicle to roll end over end over end, wherein the vehicle body is an assembly including:

a central body; and first and second skid members extended generally radially from the central body, each skid member having a first end and a second end and having a generally arcuate shaped lateral side profile between the first and second ends, the first and second skid members being positioned outwardly from the central body to protect the central body during roll over.

10. A toy vehicle having a front end and a rear end and first and second lateral sides comprising:

a housing;

a plurality of road wheels located generally beneath the housing and including at least one road wheel rotatably mounted proximate the rear end of the toy vehicle so as to at least partially support the rear end and at least one road wheel rotatably mounted proximate the front end of the toy vehicle so as to at least partially support the front end;

a lift mechanism at least partially supported by the housing, the lift mechanism including:

a lift arm having first and second ends, the lift arm being pivotally mounted proximate the first end so as to pivot with respect to the housing between a retracted position so as to enable the toy vehicle to be supported on a surface by the plurality of road wheels and an extended position in contact with the surface supporting the toy vehicle so as to raise the plurality of road wheels from the surface;

a lift arm actuating motor;

a lift arm drive screw operatively coupled with the lift arm actuating motor;

a lift arm drive nut in threaded engagement with the lift arm drive screw;

and a strut operably coupled between the drive nut and the lift arm at a point intermediate the lift arm first end and the lift arm second end.

11. A toy vehicle as in claim 10, further comprising a gear train operatively coupling the lift arm actuating motor and the lift arm drive screw.

12. A toy vehicle as in claim 10, further comprising:

a wing mounted to the housing so as to move into a deployed position extending outwardly from the housing when the lift arm is in the retracted position and to move into a retracted position essentially against the housing when the lift arm is in the extended position.

13. A toy vehicle as in claim 10, wherein the strut comprises a shock assembly.

14. A toy vehicle as in claim 10, wherein the strut is an assembly including a spring operably coupled with the drive nut.

15. A toy vehicle as in claim 10, further comprising a first motor drivingly coupled with at least one of the plurality of road wheels on the first lateral side.

16. A toy vehicle as in claim 15, wherein the first motor is drivingly coupled with at least a second road wheel of the plurality on the first lateral side.

17. A toy vehicle as in claim 15, further comprising a second motor drivingly coupled with at least one of the plurality of road wheels on the second lateral side, the second motor being operable independently of the first motor.

18. A toy vehicle as in claim 17, further comprising circuitry including a wireless signal receiver operatively connected to an electrical power supply, wherein the circuitry with receiver selectively operably couples the electrical power supply with each of the first and second motors and the lift arm actuating motor.

19. A toy vehicle as in claim 10, wherein the housing comprises:

a central body; and first and second skid members extended generally radially from the central body, each skid member having a first end and a second end and having a generally arcuate shaped side profile between the first and second ends, the first and second skid members being positioned outwardly from the central body to protect the central body during roll over, the side profiles of the vehicle body and the lift arm in the extended position collectively being sufficiently rounded to permit the vehicle to roll end over end over end.

20. A toy vehicle comprising:

a vehicle chassis having a front end and a rear end and first and second lateral sides;

a plurality of road wheels including at least one road wheel rotatably coupled with the chassis proximate the rear end and located on the vehicle so as to at least partially support the rear end and at least one road wheel rotatably coupled with the chassis proximate the front end and located on the vehicle so as to at least partially support the front end;

a lift mechanism attached to the chassis including:

a lift arm having first and second ends, the lift arm being pivotally connected to the chassis proximate the second end to move between a retracted position enabling the vehicle to be supported on a surface by the plurality of road wheels and an extended position in contact with the surface supporting the vehicle, and raising the plurality of road wheels from the surface;

a lift arm actuating motor;

a lift arm drive screw operatively coupled with the lift arm actuating motor;

a lift arm drive nut in threaded engagement with the lift arm drive screw; and a strut operably coupled between the drive nut and the lift arm at a point intermediate the lift arm first end and the lift arm second end.

* * * * *